US005100566A

United States Patent [19]

Agbomeirele et al.

[11] Patent Number: 5,100,566

[45] Date of Patent: Mar. 31, 1992

[54] FABRIC WRINKLE REDUCTION COMPOSITION AND METHOD

[75] Inventors: Patricia G. Agbomeirele; Thomas H. Lane, both of Midland, Mich.

[73] Assignee: Dow Corning Corporation, Midland, Mich.

[21] Appl. No.: 650,115

[22] Filed: Feb. 4, 1991

[51] Int. Cl.[5] ..... D06M 10/08

[52] U.S. Cl. ..... 252/86; 252/8.7; 252/8.8; 252/8.9

[58] Field of Search ..... 252/8.6, 8.7, 8.8 R, 252/8.9

[56] References Cited

U.S. PATENT DOCUMENTS

| | | | |
|---|---|---|---|
| 4,087,240 | 5/1978 | Reinert et al. | 252/8.6 |
| 4,344,860 | 8/1982 | Plueddemann | 252/389 |
| 4,419,391 | 12/1983 | Tanaka et al. | 252/8.8 |
| 4,534,880 | 8/1985 | Kosal | 252/174.4 |
| 4,549,979 | 10/1985 | Chandra | 252/135 |
| 4,741,862 | 5/1988 | Kosal | 252/527 |
| 4,806,254 | 2/1989 | Church | 252/8.8 |
| 4,911,852 | 3/1990 | Coffindaffer | 252/8.8 |
| 4,911,853 | 3/1990 | Coffindaffer | 252/8.8 |
| 4,923,623 | 5/1990 | Coffindaffer | 252/8.8 |

*Primary Examiner*—A. Lionel Clingman
*Assistant Examiner*—William S. Parks
*Attorney, Agent, or Firm*—Jim L. Decesare

[57] ABSTRACT

A method of reducing wrinkles in fabrics by applying to the fabrics to be treated an aqueous alcoholic solution of an anionic siliconate having the formula $$(MO)_aO_{(3-a)/2}Si—R—Y_b$$

wherein M is an alkali metal cation or hydrogen; R is an organic linking group; Y is an alkali metal salt of an oxyacid; a is an integer having a value of from one to three; and b is an integer having a value of from 0.5 to three. A composition including a mixture of the anionic siliconate with glycerin is also disclosed.

26 Claims, No Drawings

FABRIC WRINKLE REDUCTION COMPOSITION AND METHOD

BACKGROUND OF THE INVENTION

This invention relates to the reduction of wrinkles in fabrics used for clothing, and more particularly relates to compositions and methods for removing wrinkles from garments using certain aqueous alcoholic solutions of anionic siliconates.

Wrinkles in clothing are a cause of consternation not only to those who wear the clothing but to those in the laundering and cleaning business who process the fabrics. Wrinkles in garments are caused by bending and creasing the textile material which places the external portion of each filament in a yarn under tension while the internal portion of each filament in the yarn is placed under compression. The wrinkling of a garment is therefore subject to the inherent tensional elastic deformation and recovery properties of the fibers which constitute the yarns and fabrics. Various test methods which have been devised have determined that materials which exhibit recovery angles greater than one hundred thirty-five degrees are considered to be good wrinkle resistance performers.

One solution to the problem of garment wrinkling has been the development of durable press or permanent press clothing. The fabric is treated with an uncured resin. The garment maker presses and bakes the garment to cure the resin and sets the garment in the desired configuration. Such garments have durable permanent pleats, creases, and flat areas that are insensitive to creases and wrinkles under both wet and dry conditions. These garments may be wet laundered and dried without wrinkling and generally may be worn without requiring ironing.

A more recent approach to wrinkle reduction has been the discovery that certain curable amine functional silicones capable of forming polymeric elastomers have a beneficial effect on wrinkle reduction when deposited on fabrics. In U.S. Pat. No. 4,911,852, issued Mar. 27, 1990, a liquid laundry detergent containing these curable amine functional silicones is disclosed. A dry cleaning fluid containing these curable amine functional silicones is taught in U.S. Pat. No. 4,911,853, issued Mar. 27, 1990. In U.S. Pat. No. 4,923,623, issued May 8, 1990, these curable amine functional silicones constitute an ingredient in a liquid laundry starch product. While the compositions of the present invention include organic compounds of silicon, the compounds of the present invention are anionic siliconates rather than polymeric elastomers and organofunctional silicones as described in the above patents.

SUMMARY OF THE INVENTION

This invention is directed to method of reducing wrinkles in fabrics. The wrinkles are removed in accordance with the present invention by applying to the fabrics to be treated an aqueous alcoholic solution of an anionic siliconate. The anionic siliconate has the formula $$(MO)_aO_{(3-a)/2}Si—R—Y_b$$

wherein M is an alkali metal cation or hydrogen; R is an organic linking group; Y is an alkali metal salt of an oxyacid; a is an integer having a value of from one to three; and b is an integer having a value of from 0.5 to three.

The present invention is also directed to a composition for treating fabrics which is an aqueous alcoholic solution of glycerin and the anionic siliconate noted above.

These and other features, objects, and advantages of the present invention will become apparent from a consideration of the following detailed description thereof.

DETAILED DESCRIPTION OF THE INVENTION

Anionic siliconates are known materials and are described in U.S. Pat. Nos. 3,198,820, 3,816,184, 4,235,638, 4,344,860, 4,352,742, 4,354,002, 4,362,644, 4,370,255, 4,534,880, 4,549,979 and 4,741,862, which are hereby incorporated by reference to illustrate the anionic functional siliconates and to show methods for their preparation. The general form of the anionic siliconates can be represented by the formula:

$$(MO)_aO_{(3-A)/2}Si—R—Y_b$$

wherein R is an organic linking group. An anionic functionality Y is positioned at least 2 and preferably at least 3 carbon atoms removed from the silicon atom. The integer b represents the number of anionic functional groups on the linking group and can vary from 1 to 3. M represents the cation of a strong base such as alkali metal cations or organo quaternary ammonium cations or M represents a hydrogen such that the siliconate also contains silanol functionality. Generally a can vary from about 1 to 3.

It is preferred that a has the value of 3 to about 2 such that the anionic siliconate is predominately a monomeric species in aqueous solutions. Monomers are preferred. It should be understood however that oligomeric anionic siliconates where a is 1 to about 2 are also useful in the invention. Under alkaline conditions the oligomers are in equilibrium with monomers. It should also be apparent that if desired the equilibrium can be shifted toward monomeric species by the addition of alkali metal hydroxide to the aqueous solution of the siliconate.

The organic linking group R, may contain other atoms in addition to carbon and hydrogen such as, for example, oxygen, sulfur, and nitrogen. These atoms may be present, as other functional groups such as, for example, ether, sulfide, hydroxy, amide, or amine. Other functionality as represented by these exemplary atoms should be positioned at least 2 and preferably 3 or more carbon atoms removed from the site of silicon atom attachment in the linking group. Such positioning of functionality within the linking group provides substituents on silicon that are more stable and less readily cleaved. Generally it is preferred that the linking group contain from 2 to a maximum of about 16 carbon atoms. While linking groups with greater than 16 carbon atoms may be used in the invention, it is believed that the hydrophobic character produced by such linking groups reduce the effectiveness of the siliconates so that the linking groups with greater than 16 carbon atoms are less preferred.

Linking groups represented by R include, among others, polyvalent hydrocarbon radicals such as dimethylene, trimethylene, hexadecamethylene, phenylene, tolylene, xenylene, naphthylene, and substituted polyvalent hydrocarbon radicals such as $-(CH_2)_3OCH_2CH(OH)CH_2-$,

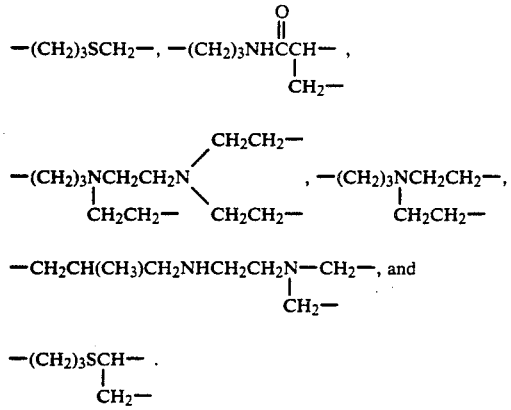

Generally when M is an alkali metal cation it is preferred that it be sodium because of its ready availability and low cost. Similarly, the sodium salts of the oxyacids are preferred anionic functional groups in the siliconates.

For example anionic siliconates suitable for the present invention include compositions conforming generally to the formulas:

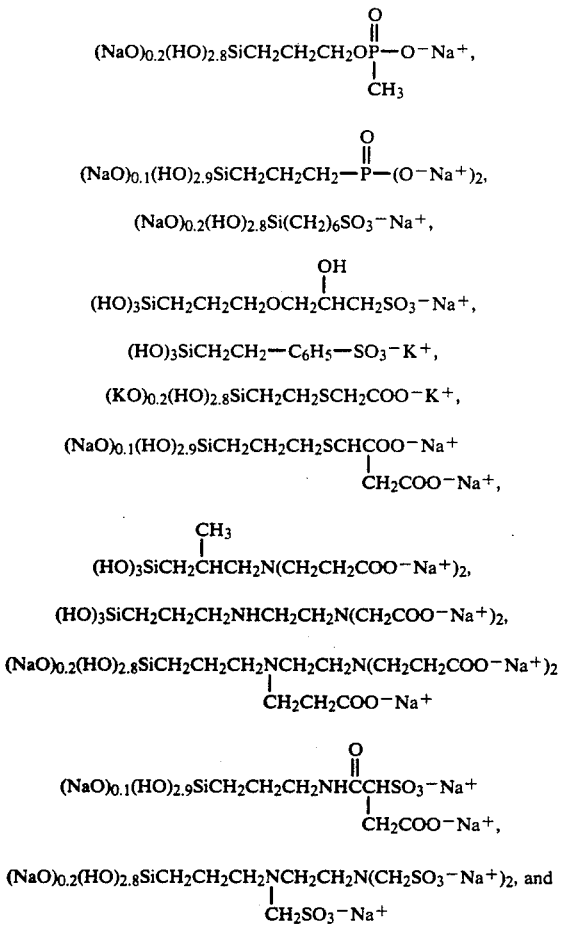

The compounds identified by Roman numerals I to V correspond to the following most preferred anionic siliconates:

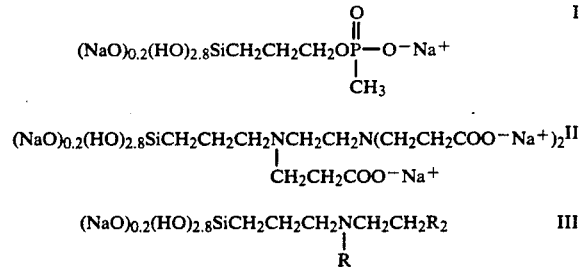

wherein R is $CH_2CH_2SO_3^-Na^+$.

| | |
|---|---|
| $(NaO)_{0.2}(HO)_{2.8}SiCH_2CH_2SCH_2COO^-Na^+$, and | IV |
| $(NaO)_{0.2}(HO)_{2.8}SiCH_2CH_2COO^-Na^+$. | V |

In the preferred embodiment of the present invention, the the anionic siliconate is a compound of the formula $$(MO)_aO_{(3-a)/2}Si-R-Y_b$$

wherein M is an alkali metal cation or hydrogen; R is an organic linking group; Y is an alkali metal salt of an oxyacid; a is an integer having a value of from one to three; and b is an integer having a value of from 0.5 to three. Y is positioned at least two carbon atoms removed from the silicon atom; and the organic linking group R contains from two to sixteen carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen. M is selected from the group consisting of hydrogen, sodium, and potassium; and Y is selected from the group consisting of alkali metal salts of sulfonic acids, alkali metal salts of phosphonic acids, alkali metal salts of monoesters of phosphonic acids, alkali metal salts of carboxylic acids, and alkali metal salts derived from organic quaternary ammonium hydroxide compounds.

The fabric is treated by spraying the aqueous alcoholic solution of the anionic siliconate onto the fabric and allowing the fabric to dry. The fabric being treated is a material such as cotton fabric and cotton-polyester blended fabric. The solution includes a mixture of water with an alcohol such as ethanol and isopropanol, and the water and alcohol are present in the solution in a volume ratio of about 40:60. The anionic siliconate is present in the solution in an amount of from about 0.25 to about two percent by weight. The solution is treated with an acid such as hydrochloric acid in one embodiment to adjust the pH of the solution to between six and seven prior to application of the solution to the fabric. The aqueous alcoholic solution of the anionic siliconate includes glycerin in another embodiment, and the anionic siliconate and glycerin are present in the solution in a weight ratio of about 1:6, such as 1.5 percent by weight of glycerin and 0.25 weight percent of the anionic siliconate.

The compositions of the present invention are intended primarily for use by the consumer on finished garments. The compositions have been found to be effective in removing wrinkles from clothing which has been wrinkled by means of folding, packing, and daily wear. The following example is set forth in order to further illustrate the concepts embodied by the present invention.

EXAMPLE

Several samples were prepared using 40:60 water/ethanol and water/isopropanol solutions. The anionic siliconate shown above in Formula II was delivered to the fabrics in solution, and the carrier solution rapidly evaporated depositing the organosilicon compound on the fabric. Some of the samples were acidified with concentrated hydrochloric acid in order to adjust the pH of the solution of between six and seven. The samples were evaluated on six inch by six inch squares of 100 percent cotton fabric and squares of a 35 percent cotton 65 percent polyester (PE) blend. The squares were wrinkled by balling the squares by hand, and by sitting upon the squares for twenty to thirty minutes. The squares were sprayed with the solution and hung to dry using weighted clamps attached to the bottom of the squares. Evaluation of the dried squares was conducted by several individuals who ranked the squares from worst to best based upon a visual observation of the wrinkles present in each of the squares. The worst fabric square was assigned a numerical value of one progressing to the best fabric square which was assigned the highest numerical value. The control squares employed in the test were untreated fabric squares, and squares treated with only a water/alcohol solution containing no additive. The results of the tests are shown in the following tables.

TABLE I

| Additive (weight %) | Fabric | Alcohol | Ranking (Best to Worst) |
|---|---|---|---|
| 0.5% siliconate of Formula II | Cotton/PE | ethanol | 5 |
| 3.0% glycerin | Cotton/PE | ethanol | 4 |
| 0.5% siliconate of Formula II with pH adjusted | Cotton/PE | ethanol | 3 |
| water/ethanol | Cotton/PE | ethanol | 2 |
| untreated | Cotton/PE | ethanol | 1 |

TABLE II

| Additive (weight %) | Fabric | Alcohol | Ranking (Best to Worst) |
|---|---|---|---|
| 0.5% siliconate of Formula II | Cotton/PE | ethanol | 7 |
| 0.5% siliconate of Formula II with pH adjusted | Cotton/PE | ethanol | 6 |
| 3.0% glycerin | Cotton/PE | ethanol | 5 |
| 1.2% siliconate of Formula II | Cotton/PE | ethanol | 4 |
| water/ethanol | Cotton/PE | ethanol | 3 |
| 1.2% siliconate of Formula II with pH adjusted | Cotton/PE | ethanol | 2 |
| untreated | Cotton/PE | ethanol | 1 |

TABLE III

| Additive (weight %) | Fabric | Alcohol | Ranking (Best to Worst) |
|---|---|---|---|
| 0.5% siliconate of Formula II with pH adjusted | Cotton | isopropanol | 5 |
| 3.0% glycerin | Cotton | isopropanol | 4 |

TABLE III-continued

| Additive (weight %) | Fabric | Alcohol | Ranking (Best to Worst) |
|---|---|---|---|
| 1.5% glycerin | Cotton | isopropanol | 3 |
| 0.25% siliconate of Formula II | | | |
| water/isopropanol | Cotton | isopropanol | 2 |
| untreated | Cotton | isopropanol | 1 |

The above tables indicate that the squares treated with the anionic siliconates of the present invention had less wrinkles than the squares of fabrics which had been treated with other materials. The data indicates that an increase of concentration of the anionic siliconate beyond about 1.2 percent by weight has no perceptable benefit. The combination of the anionic siliconate and glycerin as an additive in Table III provided a noticeable improvement in that the fabric square had a pressed appearance and a starchy feel. Thus, according to Tables I–III, the anionic siliconate materials of the present invention have a greater effect upon reducing the number of wrinkles in fabric, with the result that the consumer is required to expend less time ironing and pressing.

It will be apparent from the foregoing that many other variations and modifications may be made in the compounds, compositions, structures, articles, and methods, described herein, without departing substantially from the essential features and concepts of the present invention. Accordingly, it should be clearly understood that the forms of the present invention described herein are exemplary only and are not intended as limitations on the scope of the invention as defined in the appended claims.

That which is claimed is:

1. A method of reducing wrinkles in fabrics comprising applying to the fabrics an aqueous alcoholic solution of an anionic siliconate, the anionic siliconate having the formula:

$$(MO)_aO_{(3-a)/2}Si—R—Y_b$$

wherein M is an alkali metal cation or hydrogen; R is an organic linking group; Y is an alkali metal salt of an oxyacid; a is an integer having a value of from one to three; and b has a value of from 0.5 to three.

2. The method of claim 1 in which R contains from two to sixteen carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen.

3. The method of claim 1 in which M is selected from the group consisting of hydrogen, sodium, and potassium; and Y is selected from the group consisting of alkali metal salts of sulfonic acids, alkali metal salts of phosphonic acids, alkali metal salts of monoesters of phosphonic acids, alkali metal salts of carboxylic acids, and alkali metal salts derived from organic quaternary ammonium hydroxide compounds.

4. The method of claim 1 in which the fabric is treated by spraying the aqueous alcoholic solution of the anionic siliconate onto the fabric and allowing the fabric to dry.

5. The method of claim 4 in which the fabric being treated is a material selected from the group consisting of cotton fabric and cotton-polyester blended fabric.

6. The method of claim 1 in which the solution includes a mixture of water with an alcohol selected from the group consisting of ethanol and isopropanol, the water and alcohol being present in the solution in a volume ratio of about 40:60.

7. The method of claim 1 in which the anionic siliconate is present in the solution in an amount of from about 0.25 to about two percent by weight.

8. The method of claim 1 which additionally includes the step of treating the solution with an acid to adjust the pH of the solution to between six and seven prior to application of the solution to the fabric.

9. The method of claim 1 in which the aqueous alcoholic solution of the anionic siliconate additionally includes glycerin.

10. The method of claim 9 in which the anionic siliconate and glycerin are present in the solution in a weight ratio of about 1:6.

11. A composition for treating fabrics comprising an aqueous alcoholic solution of glycerin and an anionic siliconate, the anionic siliconate having the formula:

$$(MO)_aO_{(3-a)/2}Si—R—Y_b$$

wherein M is an alkali metal cation or hydrogen; R is an organic linking group; Y is an alkali metal salt of an oxyacid; a is an integer having a value of from one to three; and b has a value of from 0.5 to three.

12. The composition of claim 11 in which R contains from two to sixteen carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen.

13. The composition of claim 11 in which M is selected from the group consisting of hydrogen, sodium, and potassium; and Y is selected from the group consisting of alkali metal salts of sulfonic acids, alkali metal salts of phosphonic acids, alkali metal salts of monoesters of phosphonic acids, alkali metal salts of carboxylic acids, and alkali metal salts derived from organic quaternary ammonium hydroxide compounds.

14. The composition of claim 11 in which the solution includes a mixture of water with an alcohol selected from the group consisting of ethanol and isopropanol; the water and alcohol being present in the solution in a volume ratio of about 40:60.

15. The composition of claim 11 in which the anionic siliconate is present in the solution in an amount of from about 0.25 to about two percent by weight.

16. The composition of claim 11 in which the anionic siliconate and glycerin are present in the solution in a weight ratio of about 1:6.

17. The method of claim 1 in which the anionic siliconate is a compound of the formula $$(NaO)_{0.2}(HO)_{2.8}SiCH_2CH_2CH_2O\overset{\overset{O}{\|}}{\underset{\underset{CH_3}{|}}{P}}—O^-Na^+$$

18. The method of claim 1 in which the anionic siliconate is a compound of the formula $$(NaO)_{0.2}(HO)_{2.8}SiCH_2CH_2CH_2\underset{\underset{CH_2CH_2COO^-Na^+}{|}}{N}CH_2CH_2N(CH_2CH_2COO^-Na^+)_2$$

19. The method of claim 1 in which the anionic siliconate is a compound of the formula $$(NaO)_{0.2}(HO)_{2.8}SiCH_2CH_2CH_2\underset{\underset{R}{|}}{N}CH_2CH_2R_2$$

20. The method of claim 1 in which the anionic siliconate is a compound of the formula $$(NaO)_{0.2}(HO)_{2.8}SiCH_2CH_2SCH_2COO^-Na^+$$

21. The method of claim 1 in which the anionic siliconate is a compound of the formula $$(NaO)_{0.2}(HO)_{2.8}SiCH_2CH_2COO^-Na^+$$

22. The composition of claim 11 in which the anionic siliconate is a compound of the formula $$(NaO)_{0.2}(HO)_{2.8}SiCH_2CH_2CH_2O\overset{\overset{O}{\|}}{\underset{\underset{CH_3}{|}}{P}}—O^-Na^+$$

23. The composition of claim 11 in which the anionic siliconate is a compound of the formula $$(NaO)_{0.2}(HO)_{2.8}SiCH_2CH_2CH_2\underset{\underset{CH_2CH_2COO^-Na^+}{|}}{N}CH_2CH_2N(CH_2CH_2COO^-Na^+)_2$$

24. The composition of claim 11 in which the anionic siliconate is a compound of the formula $$(NaO)_{0.2}(HO)_{2.8}SiCH_2CH_2CH_2\underset{\underset{R}{|}}{N}CH_2CH_2R_2$$

wherein R is $CH_2CH_2SO_3^-Na^+$.

25. The composition of claim 11 in which the anionic siliconate is a compound of the formula $$(NaO)_{0.2}(HO)_{2.8}SiCH_2CH_2SCH_2COO^-Na^+$$

26. The composition of claim 11 in which the anionic siliconate is a compound of the formula $$(NaO)_{0.2}(HO)_{2.8}SiCH_2CH_2COO^-Na^+$$

* * * * *